United States Patent [19]

Saruwatari et al.

[11] 4,230,539

[45] Oct. 28, 1980

[54] METHOD FOR SURFACE TREATMENT OF ANODIC OXIDE FILM

[75] Inventors: Kohichi Saruwatari; Kazuo Isawa; Masatsugu Maejima; Takao Suzuki, all of Tokyo, Japan

[73] Assignee: Fujikura Cable Works, Ltd., Tokyo, Japan

[21] Appl. No.: 55,760

[22] Filed: Jul. 9, 1979

[51] Int. Cl.[2] ..... C23B 9/02

[52] U.S. Cl. ..... 204/35 N; 204/38 A; 204/37 R

[58] Field of Search ..... 204/35 N, 37 R, 38 A, 204/42, 56

[56] References Cited

U.S. PATENT DOCUMENTS

| | | | |
|---|---|---|---|
| 2,899,368 | 8/1959 | Spooner | 204/35 N |
| 3,257,244 | 6/1966 | Barkman | 148/6.2 |
| 3,406,106 | 10/1968 | Garwood et al. | 204/37 R |
| 3,567,597 | 3/1971 | Hovey et al. | 204/38 |
| 3,591,472 | 7/1971 | Amsallem | 204/140 |
| 3,625,839 | 12/1971 | Spehner et al. | 204/37 R |
| 3,787,295 | 1/1974 | Endinger et al. | 204/35 N |

*Primary Examiner*—John H. Mack
*Assistant Examiner*—William Leader
*Attorney, Agent, or Firm*—Darby & Darby

[57] ABSTRACT

A method for the surface treatment of anodic oxide film is disclosed which comprises the steps of electrolyzing the porous surface of anodic oxide film of aluminium or aluminium alloy in an aqueous solution of ammonium thiomolybdate, optionally immersing it in an aqueous solution of ammonium thiomolybdate or alkali metal thiomolybdate and in dilute mineral acid or organic acid alternately, and subjecting it to a heat treatment so as to impregnate the micropores of the anodic oxide film with molybdenum sulfide and to fix the molybdenum sulfide therein.

8 Claims, 1 Drawing Figure

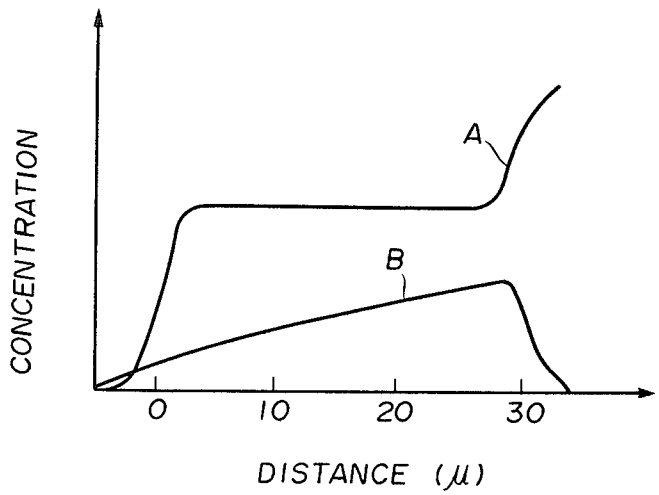
CONCENTRATION
A
B
0
10
20
30
DISTANCE (μ)

METHOD FOR SURFACE TREATMENT OF ANODIC OXIDE FILM

BACKGROUND OF THE INVENTION

1. Field of the Invention

The present invention relates to a method for the surface treatment of anodic oxide film of aluminium or aluminium alloy.

2. Description of the Prior Art

It is well known in the art to form an anodic oxide film by subjecting aluminium or aluminium alloy to the electrolytic treatment of anodic oxidation employing acid such as sulfuric acid or oxalic acid as an electrolyte. The anodic oxide film of aluminium or aluminium alloy thus formed by anodic oxidation is usually called "alumite" and is featured by a large number of micropores present therein. It is also known that under a particular treatment condition, for example, at a lower temperature of the electrolytic bath there can be formed so-called hard alumite which has a fine and hard film structure. Because of its high abrasion resistance, such hard alumite has been used widely as abrasion resisting material for those industrial machine parts for which good abrasion resistance and light weight are required.

On the other hand, however, the very feature of fine and hard structure to which the good abrasion resistance of alumite is attributable constitutes an important disadvantage of the hard alumite. The disadvantage is that such hard alumite is not good in fit to a partner member with which the alumite is in frictional contact. The hard alumite is apt to make a cohesion with the partner member, which often causes the trouble of so-called cohesive or binding friction. In particular, at the beginning of abrasion or under a relatively large load there occur "scratch" and "seizure" which accelerate the cohesive friction to a large extent.

To solve the problem it has been proposed that making use of a plurality of micropores present in an anodic oxide film, lubricant is filled in the micropores so that the cohesive friction may be prevented by improving the fitting property of the hard alumite to any frictionable partner member. However, this known method is practically unusable The size of micropores in a film formed by anodic oxidation is extremely small and is generally in the range of from 100–500 Å. It is practically impossible to fill such a small size of micropores with solid lubricant such as powder of molybdenum disulfide. It is allowed only to apply the lubricant onto the surface of such anodic oxide film. Anodic oxide films generally used as abrasion resisting material have usually a film thickness ranging from 10μ to 200μ. Therefore, the micropores also have a depth ranging from 10μ to 200μ or more. In addition, these micropores sometimes extend meanderingly to form a network structure. All of these facts put a limitation to the kind of lubricant as well as method useful for impregnating the micropores with lubricant for the above mentioned purpose.

Many attempts have been made to impregnate the micropores with various lubricants such as lubricating oil, polyethylene fluoride and colloidal carbon by immersion or electrode position. However, no satisfactory result has been obtained therefrom. This is attributable to the complicate form of micropores mentioned above. The lubricant used can not reach the interior of micropore or, even when the lubricant can enter the pores to some extent, the amount of lubricant with which the micropores are impregnated is too small to produce the desired effect. Another reason is found in lubricant itself. Since, as described above, the kind of lubricant used for impregnation is limited severely, the micropores are obliged to receive such lubricant whose abrasion resisting property is not good.

SUMMARY OF THE INVENTION

Accordingly, it is an object of the present invention to provide a surface treatment method of anodic oxide film which enables the anodic oxide film of aluminium or aluminium alloy to impregnate with a sufficient amount of molybdenum sulfide serving as a lubricant and to fix the molybdenum sulfide in the film.

It is another object of the invention to provide a surface treatment method of anodic oxide film which enables to produce such high abrasion resistance film which has a smaller coefficient of friction, a higher load resistance and a reduced tendency to cohesion.

Other and further objects, features and advantages of the invention will be apparent from the following detailed description.

According to one aspect of the invention, the above objects can be attained by electrolysing the porous surface of anodic oxide film of aluminium or aluminium alloy in an aqueous solution of ammonium thiomolybdate and then subjecting it to a heat treatment so as to impregnate the micropores in the porous surface with molybdenum sulfide and to fix the latter therein.

According to another aspect of the invention, the above objects can be attained by electrolysing the porous surface of anodic oxide film in an aqueous solution of thiomolybdate, immersing it into an aqueous solution of thiomolybdate and into dilute mineral acid solution or organic acid solution alternately and then subjecting it to a heat treatment so as to impregnate the micropores with molybdenum sulfide and to fix the latter therein.

BRIEF DESCRIPTION OF THE DRAWING

The single FIGURE is an analysis curve obtained by a microanalyzer showing the state of impregnation with molybdenum compound according to the method of the invention.

DETAILED DESCRIPTION OF THE INVENTION

First of all, a first embodiment of the invention will be described in detail.

Initially, aluminium or aluminium alloy is subjected to an electrolysis treatment of anodic oxidation employing a suitable electrolyte such as sulfuric acid or oxalic acid to form an anodic oxide film of aluminium or aluminium alloy.

Subsequently, an amount of ammonium thiomolybdate which is in a form of needle crystal and colored in blood red is dissolved in water to prepare an aqueous solution of the ammonium thiomolybdate serving as an electrolyte.

As the ammonium thiomolybdate there may be used ammonium tetrathiomolybdate, ammonium dioxodithiomolybdate, ammonium hydrogentetraoxothrithiodimolybdate and mixture thereof.

In the aqueous solution of ammonium thiomolybdate (electrolyte) thus prepared, a secondary electrolysis is carried out using the above aluminium or aluminium alloy having an anodic oxide film formed thereon as an electrode or with a separate electrode being fixed to the aluminium or aluminium alloy while using an opposite electrode of stainless steel, aluminium, carbon or lead.

The secondary electrolysis may be of direct current, alternating current or superimposed alternating current to direct current. If a direct current electrolysis or superimposed alternating current to direct current electrolysis is used, however, it is preferable to use the anodic oxide film as anode and the opposite electrode as cathode. Conditions employed for the secondary electrolysis may vary depending upon the object for which the treatment is carried out. For treatment of abrasion resisting film and that of electrolytic coloring or substrate, a constant current electrolysis, if used, may be carried suitably with the current density in the range of from 5 to 200 $mA/dm^2$. When the treatment is carried out by a constant voltage electrolysis, it may be carried out suitably with the voltage in the range of 5 to 500 V. If the current density or voltage is too low, then the secondary electrolysis can not proceed smoothly. On the contrary, if too high, there may be caused some trouble such as nonuniformity of coloring. Also, it is desirable that the concentration of ammonium thiomolybdate used as the secondary electrolyte be in the range of from 0.1 to 100 g/l. If the concentration is lower than the lower limit given above, then the color tone gets degraded or the color lacks uniformity during the secondary electrolysis. If the concentration is higher than the upper limit, then there gives arise some trouble such as nonuniformity of coloring.

When the molybdenum sulfide is deposited in the micropores of the anodic oxide film, the tone of color on the metal can be controlled by changing the amount of the compound to be deposited through a control of quantity of electricity. The controllable range of tone covers yellow, gold yellow, orange, maroon, dark brown, chocolate brown, very dark brown, black and colors existing therebetween. Such a wide range of controllable tone is never attainable by the known method of metal coloring by electrolysis. Thus, according to the invention it is made possible to obtain a colored anodic oxide film having a tone selected from the broad range of tones. This colored film has a fine and uniformly finished surface and excellent in smoothness and fading resistance.

As the next treatment step, the anodic oxide film subjected to the electrolysis treatment in the above described manner is heated at a temperature in the range of from 70° to 500° C. As a result of this heat treatment, the thiomolybdic acid electrodeposited at the first step is converted to a crystalline molybdenum sulfide. The heated film exhibits excellent brightness.

To prevent a formation of molybdenum trioxide ($MoO_3$) during the heat treatment, it is preferable to carry out the heat treatment excluding air, particularly oxygen.

While it has been found by X-ray diffraction analysis that a crystalline molybdenum disulfide ($MoS_2$) is already formed at the heating temperature of about 200° C., the use of higher temperature ranging from 200° to 500° C. is preferable since the crystallization is accelerated by it.

Mechanism of the formation of molybdenum sulfide in an anodic oxide film according to the invention may be explained as follows:

In the aqueous solution, ammonium thiomolybdate is partly dissociated into $MoS_4^{2-}$. Therefore, when electrolysis is carried out with the anodic oxide film being an anode, $MoS_4^{2-}$ migrates into the micropores and it is adsorbed and deposited therein. The deposit formed during the electrolysis is colored in black. This phenomenon suggests the formation of molybdenum trisulfide ($MoS_3$) or molybdenum disulfide ($MoS_2$).

It has been reported that in case of coloring of anodic oxide film by electrolysis of metal salt, the deposition of the metal begins at the bottom of a micropore and it proceeds toward the exit opening of the pore from the bottom. This is applied also to the case of electrolysis wherein an aqueous solution of ammonium thiomolybdate is used as its electrolyte. The result of our analysis of molybdenum (Mo) using a microanalyzer (EPMA) revealed that adsorption and deposition of $MoS_2$ also proceeded from the bottom of micropore to the exit thereof. During this electrolysis, the tone of color varies gradually with time or with the quantity of current. It changes from yellow to orange when the time of electrolysis is short and the quantity of current is small. With the increase of the current, it changes from reddish brown to black. Since the deposition of molybdenum compound begins from the innermost portion of the pores, the color obtained is in a tone deep and subdued.

According to the above described first embodiment of the invention, it is allowed to impregnate the micropores of an anodic oxide film with lubricant fully up to their bottoms in a simple manner, which is difficult to attain according to the known methods. This is because the method of the present invention has a very advantageous feature that the impregnation proceeds toward the openings of the micropores starting from their bottoms while the lubricant being deposited finely and densely from the bottoms.

As proved by abrasion tests, the colored anodic oxide films obtained according to the invention have another remarkable and advantageous feature that by the heat generated during friction there is formed an additional amount of molybdenum disulfide $MoS_2$ from the molybdenum compound impregnated with in the micropores, which assists in further improving the abrasion resistance of the film. Since, as previously described, the impregnation with molybdenum compound starts from the innermost of micropores, the lubrication effect can continue for a very long time.

As already mentioned, the amount of molybdenum compound deposited in the micropores can be changed by controlling the quantity of electricity to obtain a desired tone of color of the film surface within a specific range of tone.

Preferably, pH of the electrolyte is adjusted to 6–9. If it is desired to store the electrolyte for a long time, then it is advisable to make the electrolyte alkaline. By doing so, any deterioration of the electrolyte can be prevented. For this purpose, the pH of the electrolyte may be adjusted to 8–12 by adding a suitable alkaline substance. When used, it is readjusted to pH of 6–9. Examples of alkaline compound suitably used for this purpose include: sodium hydroxide, potassium hydroxide, calcium hydroxide, sodium carbonate, potassium carbonate, sodium hydrogenphosphate, potassium hydrogenphosphate, sodium hydrogencarbonate, potassium hydrogencarbonate, sodium borate, sodium tartrate, sodium citrate, sodium acetate, and mixtures thereof. Alkali containing $NH_4^+$ ions such as aqueous ammonia is less preferable.

Now, a second embodiment of the invention will be described in detail.

The porous surface of an anodic oxide film of aluminium or aluminium alloy is subjected to an electrolytic treatment in an aqueous solution of ammonium thiomolybdate or alkali metal thiomolybdates such as sodium thiomolybdate or potassium thiomolybdate to form an anodic oxide film.

At the second step, the film thus formed is immersed into an aqueous solution of ammonium thiomolybdate or alkali metal thiomolybdate and into an aqueous solution of dilute mineral acids or organic acids alternately. Sulfuric acid, hydrochloric acid or nitric acid may be used as mineral acid, while oxalic acid or acetic acid may be used as organic acid. For example, when ammonium thiomolybdate and sulfuric acid are used, molybdenum trisulfide in black color is formed in the micropores of the film according to the following reaction formula:

$$(NH_4)_2MoS_4 + H_2SO_4 \rightarrow MoS_3 + (NH_4)_2SO_4 + H_2S$$

After the completion of the reaction, the film is subjected to a heat treatment as the third step. By this heat treatment, the thiomolybdic acid group deposited at the first step and the molybdenum trisulfide formed at the second step are thermally decomposed into molybdenum disulfide which is crystallized. Thus, the anodic oxide film of aluminium or its alloy gets impregnated with molybdenum disulfide serving as a solid lubricant sufficiently up to the innermost portions of the micropores. During the step of alternate immersion in an aqueous solution of ammonium thiomolybdate and in that of dilute sulfuric acid, the solute enters the interiors of the micropores by diffusion so as to form molybdenum trisulfide. This reaction of forming the trisulfide takes place at first at the area of the upper opening of the micropores and with the repeated immersions it proceeds toward the bottom. Therefore, by employing this double fluid immersion process, impregnation for the area near the upper openings of micropores becomes easy.

The second embodiment employing a combination of electrolysis and alternate double fluid immersion has such merit that the micropores can be impregnated with molybdenum disulfide fully and sufficiently from bottom to top in a more effective manner.

As will be understood from the foregoing, according to the invention, whichever embodiment man uses, it is allowed to impregnate the micropores of an anodic oxide film with a sufficient amount of molybdenum disulfide having a good lubricating property up to the innermost area of the pores. Therefore, the lubrication effect by the molybdenum disulfide continues for a long time until the porous surface layer is abraded off completely.

Using those materials obtained according to the present invention there are obtainable various kinds of mechanical members and parts which are low in coefficient of friction, high in stability against load and excellent in anti-cohesion. All of the troubles such as "scratch" and "seizure" can be eliminated according to the invention.

The following examples are given as specific illustrations of the present invention. It should be understood, however, that the present invention is never limited to the specific details set forth in the examples.

The first embodiment of the present invention is illustrated by the following five examples, Examples 1 to 5.

EXAMPLE 1

A test piece in size of 100×100×1 (mm) of aluminium alloy (6IS-T6, manufactured by Showa Denko Co., Ltd.) was prepared. The metal test piece was introduced into an acid bath consisting of a mixture of an aqueous sulfuric acid solution (15 wt%) and an aqueous oxalic acid solution (3 wt%) and an electrolysis with a direct current of 3 A/dm$^2$ was carried out for an hour at 10° C. to form an anodic oxide film on the surface of the test piece. After thoroughly washing it with water, the test piece was immersed in an aqueous nitric acid solution (10 wt%) for five minutes for activation and then washed with water.

A 3l tank (12×12×20 cm) was filled with an aqueous solution of $(NH_4)_2MoS_4$ (3 wt%). A stainless steel plate in size of 10×20×0.1 cm was placed in the tank as an opposite electrode serving as a cathode while using the above film as anode. The two electrodes were spaced from each other by 6 cm and connected to a direct current source. The temperature of electrolyte was 15°-20° C.

Employing the constant current method, electrolysis was carried out with 50 mA/dm$^2$ for ten minutes. Voltage was 14-100 V.

After electrolysis, the test piece was thoroughly washed with water and dried at 70° C. for an hour. The test piece was colored in orange.

After the completion of the electrolysis treatment, the test piece was subjected to a heat treatment in nitrogen gas atmosphere at 400° C. for twenty minutes. The test piece obtained was in brilliant black color as graphite.

EXAMPLE 2

The above procedure was repeated with the exception that the temperature used for heat treatment was changed to that in the range of 200° to 500° C. Heat treatment at temperature of 200° C. to 500° C. was conducted in nitrogen gas atmosphere. On the contrary, heat treatment at temperature of 70° C. to 150° C. was conducted in air. The coefficient of friction of the treated metal test pieces was measured employing a surface measuring apparatus, HEIDON-14 (frictionable partner member: SCM 5; load: 1 kg/cm$^2$ and speed: 5 cm/min.). The results are given in the following Table 1.

TABLE 1

| Treatment temperature (°C.) | *Control | 70° C. | 100° C. | 130° C. | 150° C. | 200° C. | 300° C. | 400° C. | 500° C. |
|---|---|---|---|---|---|---|---|---|---|
| Dynamic friction coefficient | 0.53 | 0.33 | 0.30 | 0.32 | 0.25 | 0.21 | 0.22 | 0.17 | 0.17 |

*test piece for which the above impregnation treatment with molybdenum disulfide ($MoS_2$) was not carried out.

The difference in dynamic coefficient of friction between the test pieces owing to the difference of temperature was very small. Crystallization of molybdenum disulfide generally proceeds further more with the higher temperature. The small difference in dynamic coefficient of friction found in the above may be attributed to the fact that crystallization was accelerated by the action of heat generated during friction.

EXAMPLE 3

The procedure described in Example 1 was repeated with the exception that the temperature of electrolysis for the anodic oxide film was changed as shown in Table 2. Frictional abrasion loss was measured after treatment employing a Taber abrasion testing machine manufactured by Toyo Seiki Co., Ltd. (abrasion wheel: copper; load: 1 kg and revolution: 500).

The results are given in the following table, Table 2.

TABLE 2

| | | | | |
|---|---|---|---|---|
| Temperature used for electrolysis of film (°C.) | *0 | 0 | 10 | 10 |
| Loss (mg) | 89 | 1.1 | 1.2 | 1.2 |

*control for which no impregnation treatment was carried out.

In case of the control test piece, "seizure" of copper was observed. The abrasion caused therein was so severe that the anodic oxide film was peeled off while generation cracks.

In contrast, in case of test pieces treated by impregnating with molybdenum disulfide according to the invention there was observed no trouble of "seizure" of copper even for those anodic oxide films which were formed at a higher temperature. The abrasion loss was very small for every test piece treated according to the invention, as compared with the control.

EXAMPLE 4

In this example, the quantity of electricity was variously changed to obtain treated test pieces in different colors.

A test piece in size of 10×10×0.1 cm was prepared from 2S aluminium material. To form an anodic oxide film on the test piece, it was subjected to a direct current electrolysis which was carried out with 3 A/dm$^2$ for 30 minutes at 10° C. After washing with water, the test piece was immersed in a bath of 10% nitric acid for 5 minutes for activation and then washed with water.

A 3 l beaker (12×12×20 cm) was filled with an aqueous solution of $(NH_4)_2MoS_4$ (1 wt%). A stainless steel plate serving as an opposite electrode was placed in the beaker.

The film formed above as anode and the opposite electrode as cathode were disposed spaced from each other by 6 cm and connected to a direct current source. Constant current electrolysis was carried out changing variously the current density and the electrolysis time while maintainig the temperature of electrolyte at 20° C. After electrolysis, the test piece was washed with water and dried for an hour at 70° C.

The test piece treated in this manner was measured by an X-ray microanalyzer to know the distribution of concentration of the molybdenum compound deposited in the micropores. The result of this measurement is shown in the accompanying drawing as EPMA ray analysis curves. Corelation between electrolysis time and color tone is given in Table 3.

The analysis curves shown in the accompanying drawing were obtained when electrolysis was carried out with a current density of 20 mA/dm$^2$ for five minutes and show the relation between the concentration of deposit and the distance from the film surface to the substrate 2S aluminium metal. Of the two curves Curve A is of Al and Curve B is of Mo.

TABLE 3

| | Electrolysis time and tone obtained | | | | |
|---|---|---|---|---|---|
| | Tone | | | | |
| Current density | Yellow | Orange | Brown | Chocolate Brown | Black |
| 5 mA/dm$^2$ | 10 min. | 15 min. | 45 min. | 70 min. | 100 min. |
| 20 mA/dm$^2$ | 3 min. | 5 min. | 12 min. | 20 min. | 30 min. |
| 100 mA.dm$^2$ | 30 sec. | 1 min. | 2 min. | 5 min. | 7 min. |
| Voltage between electrodes | about 30 V | about 50 V | about 70 V | about 100 V | higher than 150 V |

While there may be considered various factors by which the tone is determined, including the concentration of $(NH_4)_2MoS_4$ solution and the temperature of bath, the quantity of electricity is the most determinant factor. The current density is not so determinant.

Since, as previously mentioned, the molybdenum compound which is a coloring component begins depositing from the area near the barrier layer of the film, the color obtained according to the invention has a three-dimensional depth and therefore a subdued tone.

It is another advantage of the invention that the coloring treatment can be carried out with a lower current density of electrolysis and in a shorter time as compared with the known method for metal coloring by electrolysis (alternating current method). In the known coloring process, nearly all of the coloring metal components are dissociated as cations in the electrolyte. Therefore, in order to make them electrodeposited in the film it is required to use the film as cathode, which in turn requires the use of alternating current for the practical purpose of preventing the film from being peeled off. This means that only one half of the effective alternating current value can contribute to coloring.

On the contrary, according to the method of the present invention, the coloring metal component dissociates as anion such as $MoS_4^{2-}$. Therefore, the anodic oxide film can be used as anode which allows the use of direct current electrolysis in which a large portion of the direct current is contributive to electrodeposition.

By using the film as anode there is given a possibility that some barrier layers can be formed also during metal coloring by electrolysis which has an effect for further improving the abrasion resistance and corrosion resistance not only chemically but also mechanically.

The abrasion resistance of the formed colored film was measured with a Taber abrasion testing machine after 5000 revolutions under the load of 1 kg. The following Table 4 shows the results thereof.

TABLE 4

| Test piece | Untreated film | Colored film |
|---|---|---|
| Abrasion loss | 93 mg | 2.2 mg |

It is evident from the above table that the abrasion resistance of an anodic oxide film is remarkably improved by the coloring treatment according to the invention.

The film has also a good fade resistance against sunlight. While those films formed by common organic dye became faded within five or six months, the film treated according to the invention exhibited no change in color even after about two years as for any color in the range of from yellow to black.

EXAMPLE 5

The procedure described in Example 1 was repeated with the exception that the concentration of $(NH_4)_2MoS_4$ aqueous solution was variously changed. An abrasion test was conducted in the same manner as in Example 2. Abrasion loss found in the test piece is given in the following Table 5.

TABLE 5

| Concentration of $(NH_4)_2MoS_4$ wt % | *0 | 0.01 | 0.05 | 0.1 | 0.5 | 1.0 | 3.0 |
|---|---|---|---|---|---|---|---|
| Loss mg | 95 | 1.2 | 1.1 | 1.2 | 1.1 | 1.1 | 1.2 |

*control

Although the color tone of the test pieces became deeper gradually with the increase of the concentration of the solution, there was observed only a slight difference in color in the range of 0.01 to 3.0 wt%. Every test piece showed uniformity of deposition and uniformity of coloring.

In abrasion tests, all of the test pieces treated according to the invention were free of cohesion and there was found a great difference between the test pieces according to the invenion and the control one.

The following three examples, Examples 6 to 8 illustrate the second embodiment of the present invention.

EXAMPLE 6

A test piece in the size of 100×100×1 mm of aluminium alloy (6IS-T6, manufactured by Showa Denko Co., Ltd.) was prepared. The test piece was introduced into an acid bath consisting of a mixture of an aqueous sulfuric acid solution (15 wt%) and an aqueous oxalic acid solution (3 wt%) and a direct current electrolysis with 3 A/dm$^2$ was carried out at 10° C. for an hour to form anodic oxide film. After washing with water, the test piece was immersed in an aqueous solution of nitric acid (10 wt%) for five minutes for activation and then washed with water.

A 3 l tank (12×12×20 cm) was filled with 2 l of $(NH_4)_2MoS_4$ aqueous solution (3 wt%) as an electrolyte. A stainless steel plate of 100×100×1 mm in size was placed in the tank as cathode and the test piece was also placed in the tank to use the above anodic oxide film formed thereon as anode. The two electrodes were disposed spaced from each other by 6 cm and connected to a direct current source. An electrolysis was carried out with a constant direct current of 50 mA/dm$^2$ for ten minutes while maintaining the temperature of the bath at 15°-20° C. Voltage was 14-100 V. After electrolysis, the test piece was washed with water.

Three 1 l beakers were charged with an aqueous solution of $(NH_4)_2MoS_4$ (5 wt%), an aqueous solution of sulfuric acid (1+9) and an aqueous solution of ammonia (1+9) respectively.

The test piece electrolysed at the above step was immersed in the $(NH_4)_2MoS_4$ solution for two minutes and then in the sulfuric acid solution for two minutes. Thereafter, it was immersed in the ammonia solution for neutralization followed by washing with water. This cycle of immersion procedure was repeated ten times and then it was thoroughly washed with water to wash off molybdenum trisulfide adhered to the surface of the test piece.

After drying at 70° C. for an hour, the test piece was subjected to a heat treatment in nitrogen gas atmosphere at 400° C. for two hours. The color of the test piece after the heat treatment was a brilliant black as that of graphite.

EXAMPLE 7

The procedure described in Example 6 was repeated with the exception that the temperature of heat treatment was variously changed. After the completion of treatment, dynamic coefficient of friction was measured for every test piece by employing a surface measuring apparatus, HEIDON-14 (frictionable partner member: SCM5; load 1 kg/cm$^2$ and speed: 5 cm/min.) The results obtained are given in the following Table 6.

TABLE 6

| Treatment temperature | *Untreated | 200° C. | 300° C. | 400° C. | 500° C. |
|---|---|---|---|---|---|
| Dynamic coefficient of friction | 0.53 | 0.22 | 0.22 | 0.18 | 0.17 |

*control

It was found that the difference in heating temperature between test pieces has a very slight influence on the dynamic coefficients of friction obtained and that in comparison with the control for which no impregnation treatment with molybdenum disulfide was carried out, dynamic coefficient of friction was reduced to $\frac{1}{3}$ for every case of the present invention. Analysis by X-ray diffraction showed that crystallization of molybdenum disulfide proceeded further with higher treatment temperature. But, the test results did not vary so much depending upon the treatment temperature used.

EXAMPLE 8

The procedure described in Example 6 was repeated changing the electrolysis temperature for anodic oxide films. After treatment, abrasion loss was measured for every test piece with a Taber abrasion testing machine (manufactured by Toyo Seiki Co., Ltd., abrasion wheel: copper, load: 1 kg, and revolution: 500). The result was given in Table 7.

TABLE 7

| Electrolysis temperature for film | *0° C. | 0° C. | 10° C. | 20° C. |
|---|---|---|---|---|
| Loss (mg) | 89 | 0.8 | 0.8 | 0.9 |

*control

In case of the control test piece for which no impregnation treatment with molybdenum disulfide was carried out, there was observed a trouble of "seizure" of copper and the abrasion was so severe that the anodic oxide film was peeled off while generating cracks.

For all of the test pieces treated according to the invention, there was observed no trouble of "seizure" of copper and the abrasion loss was extremely small.

EXAMPLE 9

The procedure described in Example 6 was repeated with the exception that the temperature of heat treatment was variously changed as well as 1 wt% $Na_2MoS_4$ aqueous solution and 3 wt% oxalic acid aqueous solution were used in place of 5 wt% $(NH_4)_2MoS_4$ aqueous solution and aqueous solution of sulfuric acid (1+9) at the alternate immersion step.

TABLE 8

| Treatment temperature | control | 200° C. | 300° C. | 400° C. | 500° C. |
|---|---|---|---|---|---|
| Dynamic friction coefficient | 0.53 | 0.21 | 0.23 | 0.20 | 0.20 |

As is apparent from Table 8, if sodium thiomolybdate is used in place of ammonium thiomolybdate and oxalic acid (organic acid) is used in place of sulfuric acid, the same dynamic coefficient of friction as Example 7 was obtained.

What is claimed is:

1. A method for the surface treatment of anodic oxide film which comprises the steps of electrolysing the porous surface of anodic oxide film of aluminium or aluminium alloy in an aqueous solution of ammonium thiomolybdate and then subjecting it to a heat treatment so as to impregnate the micropores of said film with molybdenum sulfide and fix the latter therein.

2. A surface treatment method according to claim 1, wherein said ammonium thiomolybdate is selected from the group consisting of ammonium tetrathiomolybdate, ammonium dioxodithiomolybdate, ammonium hydrogentetraoxotrithiodimolybdate and mixtures thereof.

3. A surface treatment method according to claim 1, wherein the concentration of ammonium thiomolybdate in said aqueous solution is in the range of from 0.1 to 100 g/l.

4. A surface treatment method according to claim 1, wherein said electrolysis is carried out according to the constant current electrolysis process with a current density in the range of from 5 to 200 mA/dm$^2$.

5. A method for the surface treatment of anodic oxide film which comprises the steps of electrolysing the porous surface of an anodic oxide film of aluminium or aluminium alloy in an aqueous solution of thiomolybdate, immersing said film into an aqueous solution of ammonium thiomolybdate or alkali metal thiomolybdate and into dilute mineral acid solution or organic acid solution alternately and then subjecting said film to a heat treatment so as to impregnate the micropores of said film with molybdenum sulfide and fix the latter therein.

6. A surface treatment method according to claim 5, wherein said ammonium thiomolybdate is selected from the group consisting of ammonium tetrathiomolybdate, ammonium dioxodithiomolybdate, ammonium hydrogentetraoxotrithiodimolybdate and mixtures thereof.

7. A surface treatment method according to claim 5, wherein the concentration of ammonium thiomolybdate in said aqueous solution is in the range of from 0.1 to 100 g/l.

8. A surface treatment method according to claim 5, wherein said electrolysis is carried out according to the constant current electrolysis process with a current density in the range of from 5 to 200 mA/dm$^2$.

* * * * *